US008345071B2

(12) United States Patent
Sakurai et al.

(10) Patent No.: US 8,345,071 B2
(45) Date of Patent: Jan. 1, 2013

(54) DISPLAY CONTROL CIRCUIT, LIQUID CRYSTAL DISPLAY DEVICE INCLUDING THE SAME, AND DISPLAY CONTROL METHOD

(75) Inventors: Ryoji Sakurai, Osaka (JP); Hiroyuki Furukawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 756 days.

(21) Appl. No.: 12/487,038

(22) Filed: Jun. 18, 2009

(65) Prior Publication Data

US 2009/0315920 A1 Dec. 24, 2009

(30) Foreign Application Priority Data

Jun. 20, 2008 (JP) ..... 2008-161342

(51) Int. Cl.
*G09G 5/10* (2006.01)

(52) U.S. Cl. ..... 345/690

(58) Field of Classification Search ..... 345/690
See application file for complete search history.

(56) References Cited

U.S. PATENT DOCUMENTS 7,277,076 B2 * 10/2007 Shiomi et al. ..... 345/89
2004/0263495 A1 * 12/2004 Sugino et al. ..... 345/204
2005/0162359 A1 * 7/2005 Sugino ..... 345/89
2005/0200631 A1 * 9/2005 Pan et al. ..... 345/600
2007/0285417 A1 * 12/2007 Prokopenko et al. ..... 345/419
2009/0225096 A1 * 9/2009 Yoshiga et al. ..... 345/545

FOREIGN PATENT DOCUMENTS

JP 4-288589 A 10/1992
WO WO-03/098588 A1 11/2003

* cited by examiner

*Primary Examiner* — Alexander S Beck
*Assistant Examiner* — Joseph Pena
(74) *Attorney, Agent, or Firm* — Birch, Stewart, Kolasch & Birch, LLP

(57) ABSTRACT

In a display control circuit of this invention, a write gray scale level determining part outputs write gray scale level data for performing overshoot drive on a liquid crystal display device. Moreover, an achievable gray scale level determining part outputs achievable gray scale level data indicating a gray scale level which achieves after a lapse of one frame. Further, an error noise predicting part compares, with a predetermined threshold value, predicted values as differences between gray scale level values of plural pieces of input image data and a mean gray scale level value of these gray scale level values to control a data selecting part such that when at least one of the predicted values exceeds the threshold value, the data selecting part gives, to an image compressing part, the input image data rather than the achievable gray scale level data predicted that a decoding error becomes large. This configuration allows suppression or elimination of after-image noise.

7 Claims, 7 Drawing Sheets

*Fig. 6*

| ACHIEVABLE GRAY SCALE LEVEL LUT | | INPUT IMAGE DATA CD | | | | | | | | |
|---|---|---|---|---|---|---|---|---|---|---|
| | | 0 | 32 | 64 | 96 | 128 | 160 | 192 | 224 | 255 |
| PRECEDING FRAME IMAGE DATA PD | 0 | 0 | 32 | 64 | 96 | 128 | 160 | 192 | 224 | 255 |
| | 32 | 2 | 32 | 64 | 96 | 128 | 160 | 192 | 224 | 255 |
| | 34 | 2 | 32 | 64 | 96 | 128 | 160 | 192 | 224 | 255 |
| | 39 | 2 | 32 | 64 | 96 | 128 | 160 | 192 | 224 | 255 |
| | 64 | 4 | 32 | 64 | 96 | 128 | 160 | 192 | 224 | 255 |
| | 96 | 6 | 32 | 64 | 96 | 128 | 160 | 192 | 224 | 255 |
| | 128 | 8 | 32 | 64 | 96 | 128 | 160 | 192 | 224 | 255 |
| | 133 | 8 | 32 | 64 | 96 | 128 | 160 | 192 | 224 | 255 |
| | 160 | 10 | 32 | 64 | 96 | 128 | 160 | 192 | 224 | 255 |
| | 192 | 12 | 32 | 64 | 96 | 128 | 160 | 192 | 224 | 255 |
| | 224 | 14 | 32 | 64 | 96 | 128 | 160 | 192 | 224 | 255 |
| | 255 | 16 | 32 | 64 | 96 | 128 | 160 | 192 | 224 | 255 |

*Fig. 7*

| ACHIEVABLE GRAY SCALE LEVEL LUT | | INPUT IMAGE DATA CD | | | | | | | | |
|---|---|---|---|---|---|---|---|---|---|---|
| | | 0 | 32 | 64 | 96 | 128 | 160 | 192 | 224 | 255 |
| PRECEDING FRAME IMAGE DATA PD | 0 | 0 | 68 | 113 | 143 | 167 | 194 | 226 | 240 | 240 |
| | 32 | 0 | 32 | 79 | 115 | 148 | 179 | 209 | 235 | 255 |
| | 34 | 1 | 31 | 78 | 114 | 148 | 179 | 209 | 235 | 255 |
| | 39 | 1 | 30 | 76 | 113 | 147 | 179 | 209 | 235 | 255 |
| | 64 | 4 | 19 | 64 | 107 | 142 | 176 | 206 | 235 | 255 |
| | 96 | 8 | 14 | 51 | 96 | 137 | 171 | 203 | 234 | 255 |
| | 128 | 16 | 11 | 42 | 89 | 128 | 166 | 199 | 230 | 255 |
| | 133 | 16 | 11 | 41 | 89 | 128 | 165 | 199 | 230 | 255 |
| | 160 | 16 | 10 | 32 | 81 | 123 | 160 | 197 | 229 | 255 |
| | 192 | 16 | 9 | 24 | 73 | 115 | 155 | 192 | 227 | 255 |
| | 224 | 16 | 8 | 19 | 64 | 108 | 149 | 189 | 224 | 255 |
| | 255 | 16 | 7 | 15 | 54 | 102 | 144 | 184 | 222 | 255 |

DISPLAY CONTROL CIRCUIT, LIQUID CRYSTAL DISPLAY DEVICE INCLUDING THE SAME, AND DISPLAY CONTROL METHOD

BACKGROUND OF THE INVENTION

1. Field of the Invention

The present invention relates to a display control circuit for displaying external input image data, a liquid crystal display device including the same, and a display control method. More specifically, the present invention relates to a display control circuit correcting input image data obtained by use of data in an immediately preceding frame, a liquid crystal display device including the same, and a display control method.

2. Description of the Background Art

A liquid crystal particle for use in a liquid crystal display device has an optical response time which is variable. The liquid crystal particle can not ensure a quick response and typically requires several tens of milliseconds. For this reason, it is preferable that this liquid crystal display device performs the following operation. For example, it is assumed herein that a display gray scale level is in a range from 0 to 255 in the liquid crystal display device. In order to display an image at the display gray scale level of 100, even when the display gray scale level is 0 in a preceding vertical display period (hereinafter, referred to as a "frame"), the liquid crystal display device changes the display gray scale level from 0 to 100 in this frame.

As described above, however, the liquid crystal particle can not ensure such a response that the display gray scale level is changed to 100 immediately. In actual, the display gray scale level achieves 100 after a lapse of several tens of milliseconds. During a period until the display gray scale level achieves 100, consequently, the liquid crystal display device continuously displays the image at the display gray scale level other than 100 (e.g., a gray scale level which is lower than 100 in a display device of a normally black type), resulting in degradation of display quality.

In order to solve the problem which causes the degradation of the display quality, that is, the problem about the response speed dealing with the change in gray scale level, conventionally, various countermeasures have been taken for the liquid crystal display device. For example, Japanese Patent Laid-Open Publication No. 04-288589 discloses a liquid crystal display device including an image memory that holds an input image signal in one frame. This liquid crystal display device detects a level variation between an input image signal in a preceding frame, which is held by the image memory, and an input image signal in a current frame. For example, this detection of the level variation corresponds to detection of the above-described change of the gray scale level from 0 to 100. Upon detection of such a level variation, an input image is subjected to high-frequency emphasis filtering, so that the liquid crystal display device can be improved in response speed. Hereinafter, this conventional configuration is referred to as a first conventional example.

Moreover, International Publication No. WO 03/098588 discloses a configuration capable of improving a response speed of a liquid crystal display device which is inferior in response performance to the liquid crystal display device described above. This configuration is different from the configuration in the first conventional example. More specifically, the liquid crystal display device obtains, based on input image data in a preceding frame, a predicted value of a display gray scale level of an image to be displayed actually thereon after a lapse of this frame, and an image memory of the liquid crystal display device holds this predicted value rather than an input image. Hereinafter, this conventional configuration is referred to as a second conventional example. According to this configuration, in order to improve the response speed, a liquid crystal particle is applied with a voltage corresponding to a value which varies largely as compared with the predicted value. For this reason, this drive method is also referred to as an overshoot drive method.

The first conventional example and the second conventional example are different from each other in the details of image data in a preceding frame, the image data being used for correcting an input image signal. However, the first conventional example and the second conventional example are equal to each other in the point that the liquid crystal display device includes the image memory holding image data in one frame. In these configurations, the liquid crystal display device includes a display panel having a display size of WXGA (1,366×768) and a display gray scale level consisting of 8-bit R data, 8-bit G data and 8-bit B data. In the liquid crystal display device, image data to be stored in the image memory has a size of about 25,000,000 (1,366×768×8×3) bits.

In order to avoid this disadvantage, U.S. Patent Publication No. 2005/0200631 discloses the following configuration. That is, image data is stored in an image memory while being compressed appropriately by a block truncation coding method so as to have a small data size. Hereinafter, this coding method is simply referred to as a BTC method. However, detailed description of the compression method described in U.S. Patent Publication No. 2005/0200631 will not be given here. Basically, the compression is performed in an irreversible manner by three methods: (1) reduction of the number of bits, (2) color space conversion and down-sampling, and (3) reduction of spatial redundancy. The compression by the BTC method corresponds to the above-mentioned method (3). This configuration allows reduction in size of the image memory and reduction in manufacturing cost. Hereinafter, this conventional configuration is referred to as a third conventional example.

The third conventional example adopts two types of codes obtained by the BTC method, that is, a low compression code containing a variable length portion (hereinafter, referred to as an LBTC (Low-compression-ratio BTC)) and a high compression code serving as a fixed length portion (hereinafter, referred to as an HBTC (High-compression-ratio BTC)). This HBTC is a mean value obtained when an input image is divided into a plurality of blocks each consisting of vertical two pixels and horizontal two pixels. Accordingly, in a case where the respective pieces of data of the four pixels contained in one block are largely different in gray scale level from each other and an HBTC obtained by compression of these pieces of data is used as a predicted value of a display gray scale level in an immediately subsequent frame for the overshoot drive described above, this predicted display gray scale level occasionally differs from an actual display gray scale level. This difference is canceled normally in the subsequent frame, but is left occasionally depending on a status of the change in data. With regard to a certain pixel in one block, for example, in a case where a gray scale level largely changes from 0 to 255 and then returns to 0 for each frame, but a mean value of the gray scale levels of the four pixels does not vary largely, the (input) gray scale level of the relevant pixel actually returns to 0, but the predicted value of the display gray scale level does not return to 0 occasionally. Such a difference is left as noise in a form of an after-image (hereinafter, simply referred to as "after-image noise") in the displayed image, resulting in degradation of display quality.

SUMMARY OF THE INVENTION

It is accordingly an object of the present invention to provide a display control circuit that, in a case of compressing image data to a code containing a fixed length portion without fail and occasionally containing a variable length portion and then decoding the data in an irreversible manner, can suppress or eliminate after-image noise generated upon correcting input image data based on the decoded image data, a liquid crystal display device including the same, and a display control method.

In order to accomplish this object, the present invention has features to be described below. That is, the present invention provides a display control circuit for receiving external input image data to generate write gray scale level data to be given to a display panel for displaying an image. This display control circuit includes: a write gray scale level determining part for generating the write gray scale level data by correcting the received input image data in accordance with an amount of shift from a gray scale level represented by preceding frame image data generated based on input image data in an immediately preceding frame period to a gray scale level represented by the currently received input image data; an achievable gray scale level determining part for generating, in accordance with the amount of shift, achievable gray scale level data of a gray scale level estimated to be displayed after a lapse of one frame period on the display panel to which the write gray scale level data is given; a predicting and selecting part for predicting whether abnormal noise is generated in the image to be displayed on the display panel, and selecting the achievable gray scale level data when it is predicted that no abnormal noise is generated while selecting the input image data when it is predicted that the abnormal noise is generated; a compressing part for compressing the data selected by the predicting and selecting part, in an irreversible manner, to a variable length code containing a fixed length portion code generated without fail and a variable length portion code generated only in a predetermined case, for each block including plural pieces of pixel data; a data storing part for storing the variable length code obtained by the data compression in the compressing part; and a decoding part for reading the variable length code from the data storing part, decoding the variable length code, and giving the decoded data as preceding frame image data in an immediately subsequent frame period to each of the write gray scale level determining part and the achievable gray scale level determining part. Herein, the predicting and selecting part predicts, based on the plural pieces of pixel data contained in the input image data, the generation of the abnormal noise related to an error to be caused when the compressing part compresses the achievable gray scale level data in the irreversible manner and then the decoding part decodes the compressed data.

In the present invention, preferably, the predicting and selecting part obtains differential values between a plurality of gray scale level values indicated by the plural pieces of pixel data and a representative value determined based on the plurality of gray scale level values, and predicts that the abnormal noise is generated when at least one of the differential values exceeds a predetermined threshold value while predicting that no abnormal noise is generated when all the differential values do not exceed the threshold value.

Also preferably, the compressing part performs the data compression by use of a BTC (Block Truncation Coding) method, and the predicting and selecting part defines, as the representative value, a mean value of the plurality of gray scale level values.

The present invention also provides a liquid crystal display device including: the display control circuit described above; and a liquid crystal display panel for displaying an image based on write gray scale level data given from the display control circuit. Herein, the liquid crystal display panel includes a video signal line drive circuit for driving a plurality of video signal lines for transmitting a plurality of video signals corresponding to the write gray scale level data, a scanning signal line drive circuit for driving a plurality of scanning signal lines intersecting the plurality of video signal lines, a plurality of pixel formation portions arranged in a matrix form along the plurality of video signal lines and the plurality of scanning signal lines, and a common electrode for giving a common potential to each of the plurality of pixel formation portions.

The present invention also provides a display control method for receiving external input image data to generate write gray scale level data to be given to a display panel for displaying an image. This display control method includes: a write gray scale level determining step of generating the write gray scale level data by correcting the received input image data in accordance with an amount of shift from a gray scale level represented by preceding frame image data generated based on input image data in an immediately preceding frame period to a gray scale level represented by the currently received input image data; an achievable gray scale level determining step of generating, in accordance with the amount of shift, achievable gray scale level data of a gray scale level estimated to be displayed after a lapse of one frame period on the display panel to which the write gray scale level data is given; a predicting and selecting step of predicting whether abnormal noise is generated in the image to be displayed on the display panel, and selecting the achievable gray scale level data when it is predicted that no abnormal noise is generated while selecting the input image data when it is predicted that the abnormal noise is generated; an image compressing step of compressing the data to be the preceding frame image data given in the write gray scale level determining step after the lapse of one frame period, to a variable length code containing a fixed length portion code generated without fail and a variable length portion code generated only in a predetermined case, for each block including plural pieces of pixel data; a compressing step of compressing the data selected in the predicting and selecting step, in an irreversible manner, to a variable length code containing a fixed length portion code generated without fail and a variable length portion code generated only in a predetermined case, for each block including plural pieces of pixel data; and a decoding step of reading the variable length code stored in a data storing part for storing the variable length code obtained by the data compression in the compressing step, decoding the variable length code, and giving the decoded data as preceding frame image data in an immediately subsequent frame period to each of the write gray scale level determining step and the achievable gray scale level determining step. Herein, the predicting and selecting step includes predicting, based on the plural pieces of pixel data contained in the input image data, the generation of the abnormal noise related to an error to be caused when the achievable gray scale level data is compressed in the irreversible manner in the compressing step and then the compressed data is decoded in the decoding step.

In the display control circuit according to the present invention, the predicting and selecting part predicts generation of abnormal noise related to an error to be caused when the compressing part compresses achievable gray scale level data in an irreversible manner and then the decoding part decodes the compressed data, based on plural pieces of pixel data contained in input image data. When it is predicted that no abnormal noise is generated, the predicting and selecting part selects the achievable gray scale level data as a target to be compressed. On the other hand, when it is predicted that the abnormal noise is generated, the predicting and selecting part selects, as a target to be compressed, the input image data rather than the achievable gray scale level data related to the decoding error. This configuration prevents generation of after-image noise or prevents at least perception of such after-image noise.

Moreover, the predicting and selecting part predicts that the abnormal noise is generated when at least one of differential values between a plurality of gray scale level values and a representative value determined based on the plurality of gray scale level values exceeds a predetermined threshold value. On the other hand, the predicting and selecting part predicts that no abnormal noise is generated when all the differential values do not exceed the threshold value. By use of a simple method, therefore, the display control circuit can accurately predict whether after-image noise is generated.

Further, the display control circuit compresses data by use of a typical BTC method as a compression method. The use of this compression method allows reduction in manufacturing cost of the compressing part.

The liquid crystal display device according to the present invention produces advantageous effects similar to those of the display control circuit according to the present invention. Moreover, the display control method according to the present invention produces advantageous effects similar to those of the display control circuit according to the present invention.

These and other objects, features, aspects and advantages of the present invention will become more apparent from the following detailed description of the present invention when taken in conjunction with the accompanying drawings.

BRIEF DESCRIPTION OF THE DRAWINGS

FIG. 6 shows an example of contents of an LUT in an achievable gray scale level determining part in the embodiment;

FIG. 7 shows an example of contents of an LUT in a write gray scale level determining part in the embodiment;

DESCRIPTION OF THE PREFERRED EMBODIMENTS

With reference to the accompanying drawings, hereinafter, description will be given of one embodiment of the present invention.

1. General Configuration of Liquid Crystal Television Set

Figure 1:
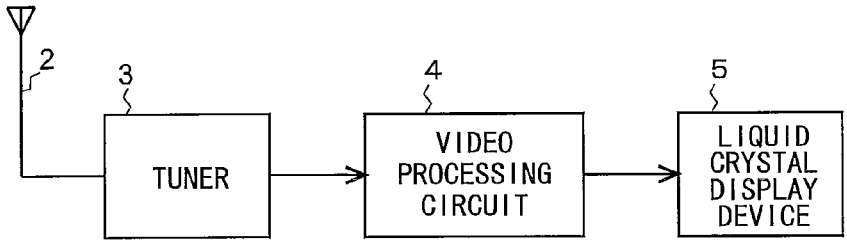
FIG. 1 shows a block diagram of a general configuration of a liquid crystal television set according to one embodiment of the present invention.

FIG. 1 shows a block diagram of a general configuration of a liquid crystal television set according to one embodiment of the present invention. This liquid crystal television set includes an antenna 2 for receiving a television broadcast, a tuner 3 for selecting desired one of plural pieces of transfer data sent by radio waves, a video processing circuit 4 for decoding the selected transfer data to extract video data, and a liquid crystal display device 5 for displaying an image based on the video data. A feature of the present invention is a display control circuit of the liquid crystal display device 5; therefore, detailed description thereof is given below with reference the drawings.

Figure 2:
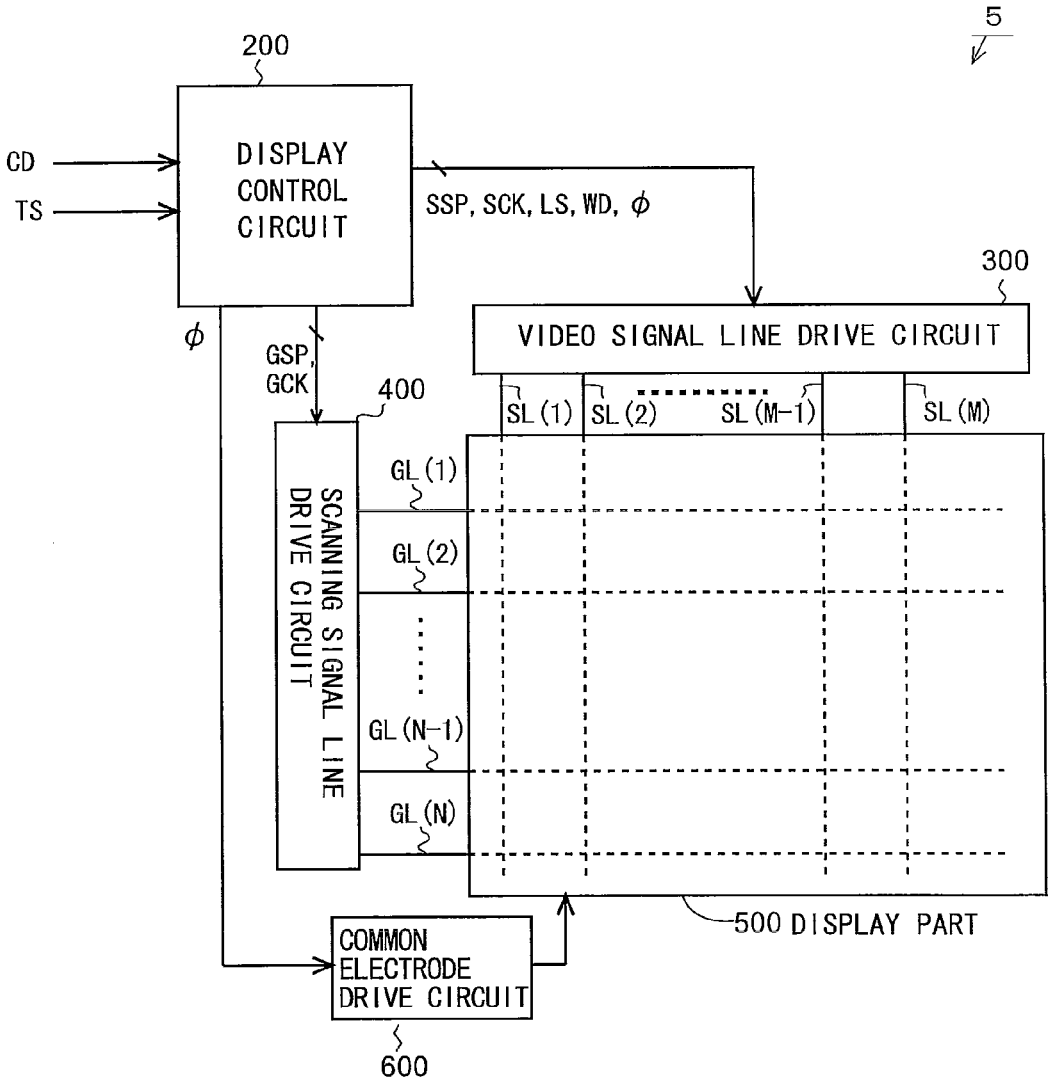
FIG. 2 shows a block diagram of a general configuration of a liquid crystal display device in the embodiment.

FIG. 2 shows a block diagram of a detailed configuration of the liquid crystal display device 5. The liquid crystal display device 5 is of an active matrix type, and includes a drive control part that includes a display control circuit 200, a video signal line drive circuit (a source driver) 300 and a scanning signal line drive circuit (a gate driver) 400, a display part 500, and a common electrode drive circuit 600. The display part 500 includes a plurality (represented by M) of video signal lines SL(1) to SL(M), a plurality (represented by N) of scanning signal lines GL(1) to GL(N), and a plurality (represented by M×N) of pixel formation portions formed at intersections of the plurality of video signal lines SL(1) to SL(M) and the plurality of scanning signal lines GL(1) to GL(N), respectively. Each pixel formation portion includes a TFT (Thin Film Transistor) serving as a switching element having a gate terminal connected to the scanning signal line GL(n) passing through the relevant intersection and a source terminal connected to the video signal line SL(m) passing through the intersection, a pixel electrode connected to a drain terminal of the TFT, a common electrode (also referred to as a "counter electrode") shared among the respective pixel formation portions, and a liquid crystal layer serving as an electro-optical element held between the pixel electrode and the common electrode. The TFT becomes conductive in such a manner that the scanning signal line GL(n) is selected when a scanning signal G(n) to be applied thereto becomes active. Then, the pixel electrode is applied with a driving video signal S(m) through the video signal line SL(m). Thus, a voltage of the applied driving video signal S(m) is written as a display value to the pixel formation portion including the pixel electrode.

The display control circuit 200 receives external input image data CD and an external timing control signal TS, and outputs write gray scale level data WD which is a digital image signal as well as a source start pulse signal SSP, a source clock signal SCK, a latch strobe signal LS, a gate start pulse signal GSP, a gate clock signal GCK and a polarity inversion signal $\phi$ each of which is used for controlling a timing that an image is displayed on the display part 500.

The video signal line drive circuit 300 receives the write gray scale level data WD, the source start pulse signal SSP, the source clock signal SCK and the latch strobe signal LS from the display control circuit 200, and applies the driving video signal (herein, the write gray scale level data WD to be described later) to each of the video signal lines SL(1) to SL(M) in order to charge a liquid crystal capacitance and an auxiliary capacitance of each pixel formation portion in the display part 500. Herein, the write gray scale level data WD indicating a voltage to be applied to each of the video signal lines SL(1) to SL(M) is held in sequence by the video signal line drive circuit 300 at a timing of generation of a pulse for the source clock signal SCK. Then, the held write gray scale level data WD is converted to an analog voltage at a timing of generation of a pulse for the latch strobe signal LS. The converted analog voltage is applied as the driving video signal to all the video signal lines SL(1) to SL(M) at a time. As described above, herein, a desired gray scale level is not achieved occasionally depending on an optical response speed of a liquid crystal. Moreover, the video signal applied to each of the video signal lines SL(1) to SL(M) has a polarity which is inverted in accordance with the polarity inversion signal ϕ outputted from the display control circuit 200, because of alternating drive in the display part 500.

Based on the gate start pulse signal GSP and the gate clock signal GCK each outputted from the display control circuit 200, the scanning signal line drive circuit 400 applies in sequence an active scanning signal to each of the scanning signal lines GL(1) to GL(N).

The common electrode drive circuit 600 generates a common voltage Vcom which is a voltage to be applied to the common electrode of the liquid crystal. In this embodiment, the common electrode has a potential which varies in accordance with the alternating drive in order to suppress an amplitude of the voltage on the video signal line.

As described above, when the driving video signal is applied to each of the video signal lines SL(1) to SL(M) and the scanning signal is applied to each of the scanning signal lines GL(1) to GL(N), an image is displayed on the display part 500.

2. Configuration and Operations of Display Control Circuit

Figure 3:
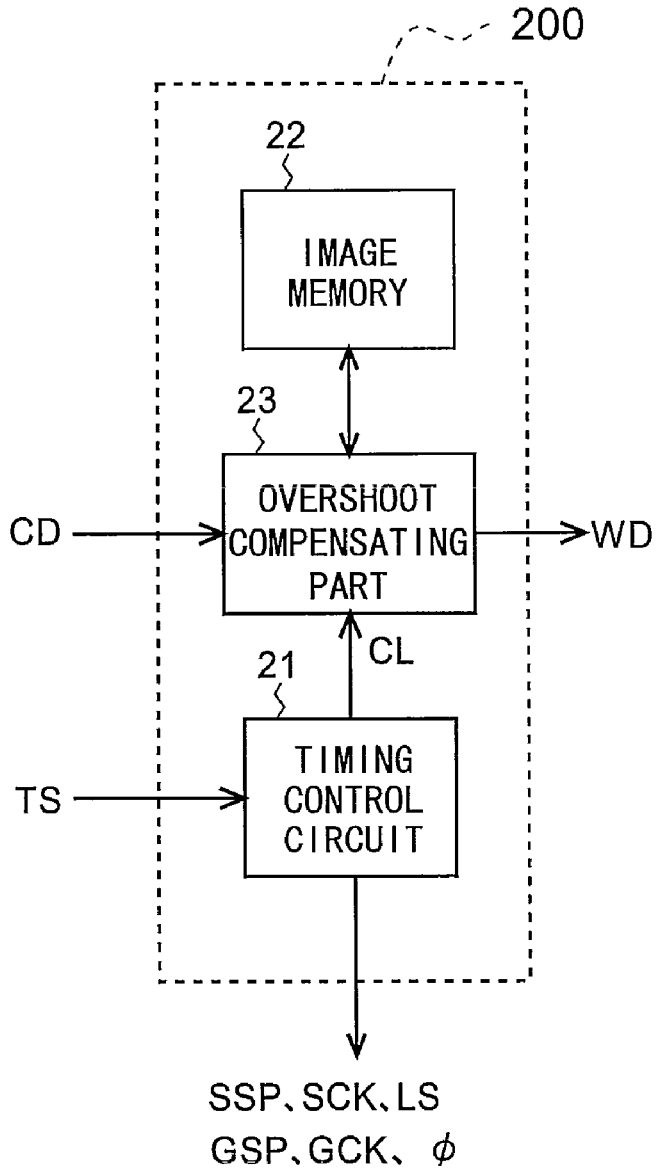
FIG. 3 shows a block diagram of a configuration of a display control circuit in the embodiment.

FIG. 3 shows a block diagram of a configuration of the display control circuit 200 in this embodiment. The display control circuit 200 includes a timing control circuit 21 that performs timing control, an image memory 22 that stores write gray scale level data WD in one frame, and an overshoot compensating part 23 that receives a display value (display gray scale level data) contained in external input image data CD and generates and outputs write gray scale level data WD (which performs optical response compensation on the liquid crystal) for performing overshoot drive, based on a control signal given from the timing control circuit 21, while referring to the received display value and the write gray scale level data WD in the preceding frame stored in the image memory 22.

The timing control circuit 21 receives an external timing control signal TS, and outputs a control signal CL which is used for controlling an operation of the overshoot compensating part 23 as well as a source start pulse signal SSP, a source clock signal SCK, a latch strobe signal LS, a gate start pulse signal GSP, a gate clock signal GCK and a polarity inversion signal ϕ each of which is used for controlling a timing that an image is displayed on the display part 500.

Based on the display value corresponding to one pixel contained in the external input image data CD, the control signal CL given from the timing control circuit 21, and the data corresponding to the past write gray scale level data WD in the preceding frame of the corresponding pixel read from the image memory 22 (hereinafter, referred to as "preceding frame image data PD"), the overshoot compensating part 23 generates and outputs the write gray scale level data WD by which the overshoot drive is realized in the display part 500. The configuration of the overshoot compensating part 23 is described in further detail with reference to FIG. 4.

3. Configuration and Operations of Overshoot Compensating Part

Figure 4:
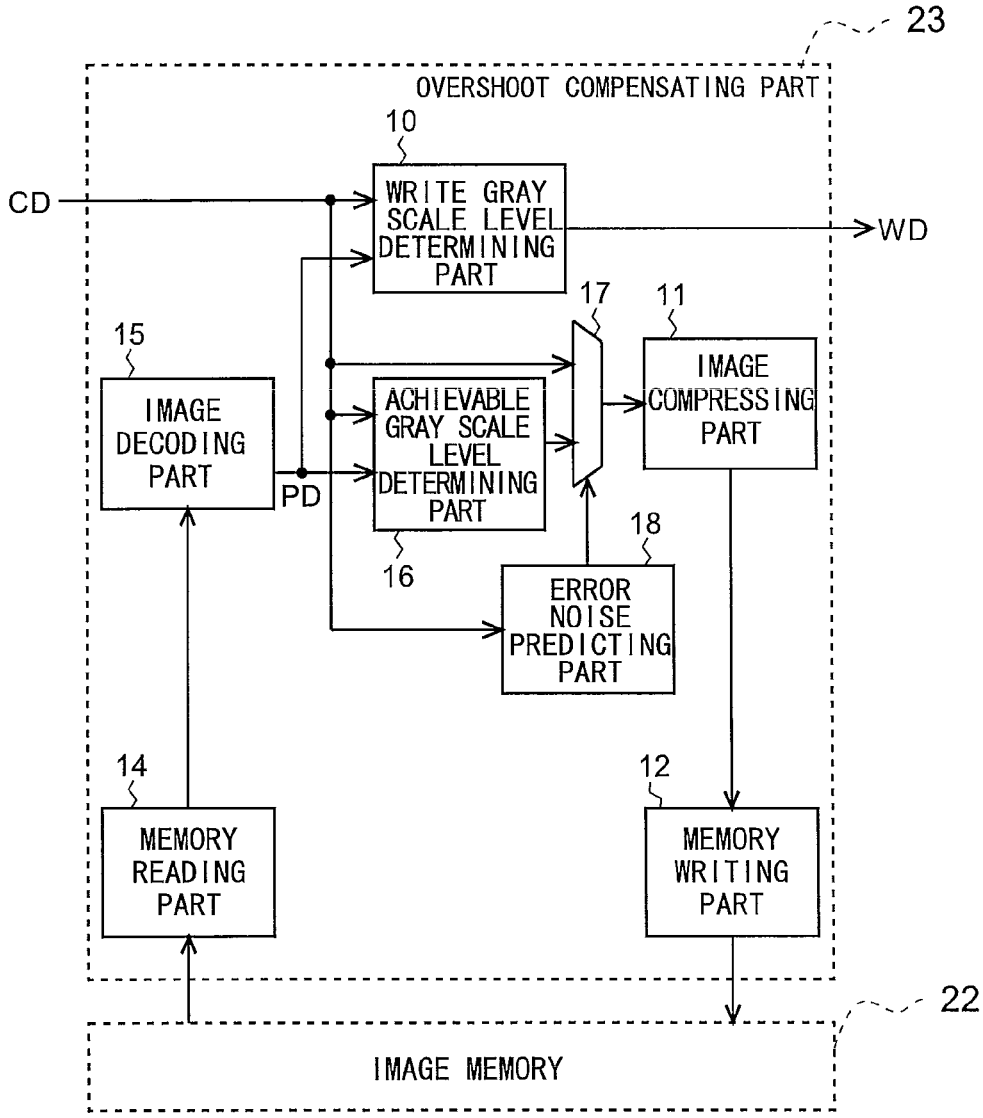
FIG. 4 shows a block diagram of a configuration of an overshoot compensating part in the embodiment.

FIG. 4 shows a block diagram of the configuration of the overshoot compensating part in this embodiment. As shown in FIG. 4, the overshoot compensating part 23 includes a write gray scale level determining part 10, an achievable gray scale level determining part 16, a data selecting part 17, an error noise predicting part 18, an image compressing part 11, a memory writing part 12, a memory reading part 14 and an image decoding part 15. Herein, the write gray scale level determining part 10 outputs write gray scale level data WD for performing the overshoot drive on the liquid crystal display device including the display control circuit, based on external input image data CD (in a current frame) and preceding frame image data PD. The achievable gray scale level determining part 16 outputs achievable gray scale level data indicating a gray scale level which achieves after a lapse of one frame period in the liquid crystal display device, based on the input image data CD and the preceding frame image data PD. The data selecting part 17 receives the input image data CD and the achievable gray scale level data, and outputs one of the input image data CD and the achievable gray scale level data. The error noise predicting part 18 calculates a predicted value for predicting generation of after-image noise by a decoding error (to be described later), based on the input image data CD, and controls the data selecting part 17, based on a result of the calculation. The image compressing part 11 compresses the data outputted from the data selecting part 17. The memory writing part 12 writes the compressed data to the image memory 22. The memory reading part 14 reads the compressed data from the image memory 22. The image decoding part 15 decodes the read data as the preceding frame image data PD.

The write gray scale level determining part 10 has a lookup table (LUT) that provides a relation between the input image data CD and the write gray scale level data WD corresponding to the preceding frame image data PD. The write gray scale level determining part 10 refers to this LUT to output the write gray scale level data WD. The LUT is created by previously calculating optimal write gray scale level data in accordance with display characteristics of the liquid crystal display device. Herein, the calculated write gray scale level data corresponds to an amount of shift of a gray scale level from image data in a preceding frame. The LUT will be described later with reference to FIG. 6.

The achievable gray scale level determining part 16 outputs achievable gray scale level data indicating a gray scale level which achieves after a lapse of one frame period in the liquid crystal display device, based on the external input image data CD and the preceding frame image data PD. As described above, when the optical response speed of the liquid crystal is relatively slow, a time more than one frame period is required occasionally until achievement of the gray scale level indicated by the write gray scale level data WD given to the liquid crystal display device. Accordingly, more accurate drive can be performed in such a manner that preceding frame image data PD, which is referred to in the case of performing the overshoot drive, is defined as data of a gray scale level which actually achieves after a lapse of one frame period. The achievable gray scale level determining part 16 has a lookup table (LUT) which provides a relation between the input image data CD and the achievable gray scale level data corresponding to the preceding frame image data PD. The achievable gray scale level determining part 16 refers to this LUT to output the achievable gray scale level data. The LUT is created by previously calculating achievable gray scale level data of a gray scale level predicted to achieve actually, in accordance with display characteristics of the liquid crystal display device. Herein, the calculated achievable gray scale level data corresponds to an amount of shift of a gray scale level from image data in a preceding frame. The LUT will be described later with reference to FIG. 7.

The image compressing part 11 receives the input image data CD or the achievable gray scale level data which is selected by the data selecting part 17, compresses the received data by use of the BTC method described above, and outputs an HBTC which is a fixed length code or an LBTC which is a code containing a variable length portion. As described above, the LBTC consists of a fixed length portion code and a variable length portion code whereas the HBTC consists of only a fixed length portion code. In the following, the HBTC and the LBTC are correctively referred to as a variable length code. Herein, moreover, the term "HBTC" or "LBTC" is not used as a designation of a compression method which is further classified from the BTC.

Herein, the BTC is described briefly. The BTC is a well-known compression method in which a threshold value for determining a compression ratio is given as a parameter. In this compression method, first, an input image is divided into a plurality of blocks each consisting of two vertical pixels and two horizontal pixels, and a mean value of gray scale level values is obtained for each block. This mean value serves as an HBTC (High-compression-ratio BTC). Further, a differential value between the mean value and the gray scale level value is obtained for each pixel. About only the block in which this differential value exceeds a threshold value 0, data indicating the differential value between the mean value and the gray scale level value for each pixel is generated. This differential value serves as a variable length (variable length portion code), and code data indicating a sum of the variable length and the mean value which is a fixed length (fixed length portion code) serves as an LBTC (Low-compression-ratio BTC). The entire input image is subjected to the processing described above, so that input image data can be compressed by use of spatial redundancy. Herein, as the threshold value is smaller, the number of blocks in which the differential value exceeds the threshold value becomes larger. As a result, the frequency of generation of the LBTC becomes high, leading to increase of an amount of data to be written to an image memory. In other words, the compression ratio is low. On the other hand, as the threshold value is larger, the frequency of generation of the LBTC becomes low. As a result, the compression ratio is high. As described above, the setting of the threshold value allows control of the compression ratio. This embodiment adopts the BTC method described above. In place of the BTC method, this embodiment may adopt a well-known compression method in which after-image noise is generated in relation to a decoding error of data decoded after being compressed.

The memory writing part 12 controls a position (address) where data is written to the image memory 22, and writes data of the HBTC or data of the LBTC given from the image compressing part 11 to the write position in the image memory 22.

The memory reading part 14 controls a position (address) where data is read from the image memory 22, and reads data of the HBTC or data of the LBTC corresponding to the preceding frame image data PD from the read position in the image memory 22.

The image decoding part 15 decodes, to the preceding frame image data PD, the data read by the memory reading part 14, and gives the decoded preceding frame image data PD to each of the write gray scale level determining part 10 and the achievable gray scale level determining part 16.

Based on the received input image data CD, the error noise predicting part 18 calculates a predicted value for determining whether the after-image noise is generated by the decoding error to be caused in the case where the achievable gray scale level data is subjected to image compression and decoding. Herein, the decoding error refers to an erroneous difference between a (correct) value before compression and a value which is obtained in such a manner that the correct value is compressed to obtain an HBTC and then the HBTC is decoded. In other words, the decoding value of the HBTC is a mean gray scale level value of four pixels in one block; therefore, the decoding error is a difference between the mean value and the value before compression.

The error noise predicting part 18 predicts that the after-image noise is generated in the case where the decoding error is large and the difference in gray scale level value among the four pixels of the input image data CD contained in the corresponding one block is large. Therefore, the error noise predicting part 18 compares, with a predetermined threshold value, differences between the respective gray scale level values of the four pixels contained in the input image data CD and the mean gray scale level value of the gray scale level values. Hereinafter, this difference is referred to as a "predicted value". When at least one of the predicted values exceeds the threshold value, the error noise predicting part 18 controls the data selecting part 17 such that the data selecting part 17 gives, to the image compressing part 11, the input image data CD rather than the achievable gray scale level data. The data selecting part 17 is controlled as described above for the following reason. It is assumed herein that the predicted value exceeds the threshold value. In such a case, it is considered that if the achievable gray scale level data, which is obtained based on the input image data CD, is subjected to image compression and decoding, the after-image noise is generated when the decoded data is used for overshoot drive. Next, the reason of this consideration and the reason why the after-image noise is suppressed by the configuration described above are described in detail with reference to FIG. 5 to FIG. 7.

Figure 5:
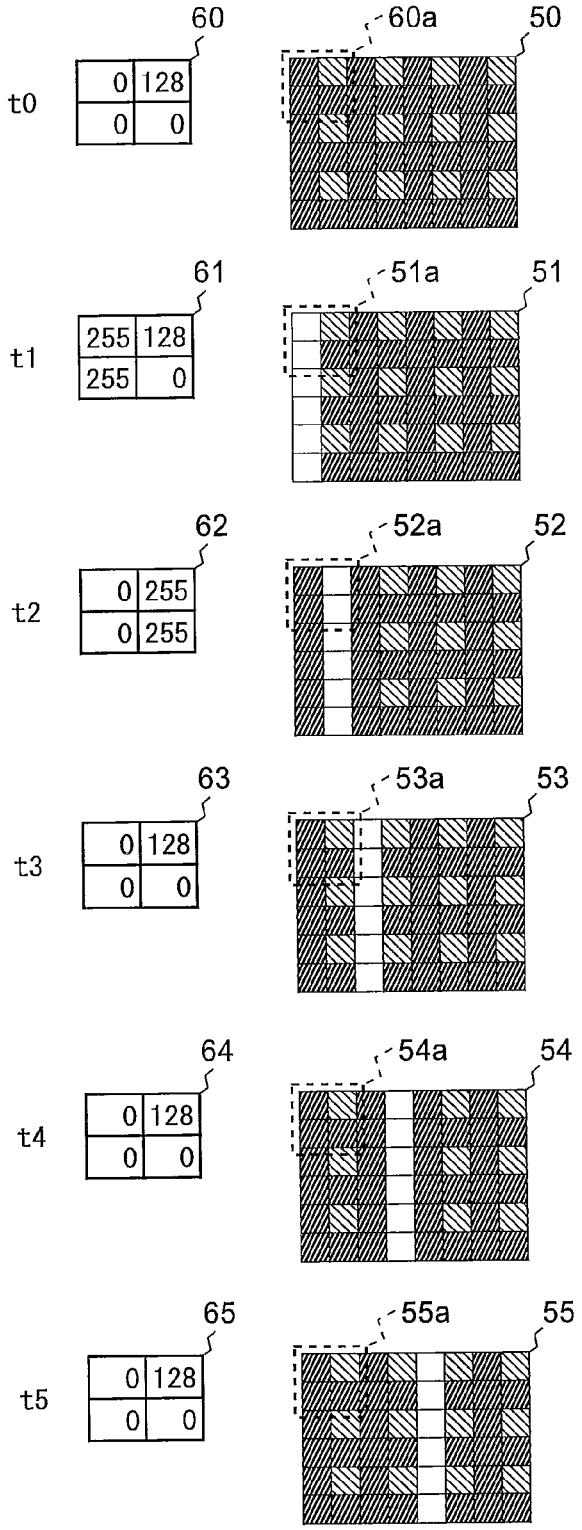
FIG. 5 shows a part of a display image that varies for each frame period and input image data of the display image, in the embodiment.

4. Example of Generation of After-Image Noise, and Operation for Suppressing After-Image Noise FIG. 5 shows a part of a display image that varies for each frame period and input image data of the display image. Specifically, FIG. 5 shows five frame periods from a time t0 to a time t5, partial display images 50 to 55 displayed at the respective times, four pixels 50*a* to 55*a* forming one block contained in the partial display images 50 to 55, and plural pieces of input image data 60 to 65 as gray scale level values of the four pixels 50*a* to 55*a*.

Herein, the display images 50 to 55 are used for description of the after-image noise; therefore, the input image data CD is displayed as it is. For this reason, the display images 50 to 55 are not subjected to the overshoot drive in this embodiment.

It is apparent from FIG. 5 that the display image 50 displayed at the time t0 has a specific pattern and is similar in pattern to each of the subsequent display images 51 to 55. However, the display image 51 displayed at the time t1 has a white line extending vertically on a first column in addition to the pattern, and the display image 52 displayed at the time t2 has a white line extending vertically on a second column in addition to the pattern. In the subsequent display images, such a white line is shifted rightward one column by one column every a lapse of one frame period. Of course, these images contain no after-image noise. However, when the overshoot drive is performed by use of the achievable gray scale level data, the after-image noise is generated in the case where the input image data shown in FIG. 5 is given. Next, the generation of the after-image noise is described with reference to FIG. 6 to FIG. 8.

FIG. 6 shows an example of contents of an LUT in the achievable gray scale level determining part, and FIG. 7 shows an example of contents of an LUT in the write gray scale level determining part. More specifically, FIG. 6 shows typical gray scale level values of the input image data CD in a horizontal direction, typical gray scale level values of the preceding frame image data PD in a vertical direction, and values of the achievable gray scale level data as output values corresponding to these gray scale level values in the table. Likewise, FIG. 7 shows typical gray scale level values of the input image data CD in a horizontal direction, typical gray scale level values of the preceding frame image data PD in a vertical direction, and values of the write gray scale level data WD as output values corresponding to these gray scale level values in the table.

The function of suppressing or eliminating the after-image noise of each of the data selecting part 17 and the error noise predicting part 18 of the display control circuit 200 is described with reference to these values. Therefore, description will be given of a case where the after-image noise is generated when the image compressing part 11 receives the input image data CD shown in FIG. 5 on the assumption that the display control circuit 200 does not include the data selecting part 17 and the error noise predicting part 18 and the image compressing part 11 receives only the achievable gray scale level data from the achievable gray scale level determining part 16 to compress the achievable gray scale level data. It is assumed herein that highly compressed HBTC is generated by the compression in the image compressing part 11 for convenience of the description.

Figure 8:
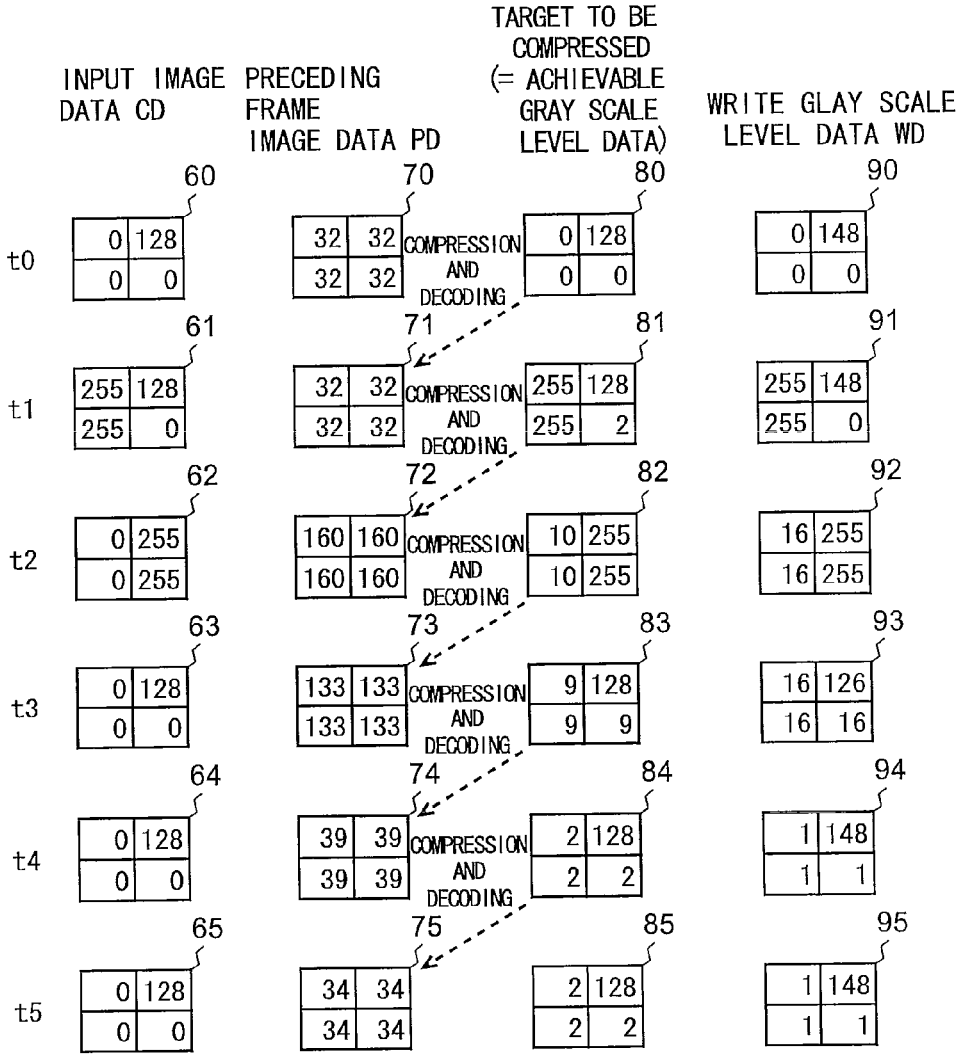
FIG. 8 shows an example of gray scale level values of four pixels in one block contained in each data in a case where a data selecting part and an error noise predicting part in the embodiment are not provided.

FIG. 8 shows an example of gray scale level values of four pixels in one block contained in each data in the case where the data selecting part and the error noise predicting part are not provided. The plural pieces of input image data CD in FIG. 8 correspond to the plural pieces of input image data CD in the five frame periods from the time t0 to the time t5 in FIG. 5. The contents of the preceding frame image data 70 at the time t0 are fixed based on the input image data CD in the preceding frame period and the achievable gray scale level data. It is assumed herein that the contents of the input image data CD do not vary before the time t0. The contents of the preceding frame image data 70 at the time t0 correspond to the gray scale level values of (32, 32, 32, 32) obtained by decoding a numeric value of 32 which is a mean value of the gray scale level values of (0, 128, 0, 0) of the four pixels corresponding to the contents of the input image data CD. In the following, gray scale level values of four pixels contained in one block are expressed as described above, that is, are expressed such that an upper left value, an upper right value, a lower left value and a lower right value each separated by a comma are parenthesized.

As shown in FIG. 8, at the time t1, a white line (a portion having a large gray scale level), which is similar to that in the display image 51 shown in FIG. 5, is reflected on a part of the pixel contained in the block. At the time t3 in which the white line is not reflected on the pixel, the achievable gray scale level data 83 is not coincident with the input image data 63 and has a gray scale level which is relatively large. Thereafter, achievable gray scale level data as a target to be compressed is coincident with the achievable gray scale level data 83 when the input image data does not vary, because the data selecting part 17 and the error noise predicting part 18 are not provided. However, each of the achievable gray scale level data 84 at the time t4 and the achievable gray scale level data 85 at the time t5 has contents of (2, 128, 2, 2) which are not coincident with the contents of (0, 128, 0, 0) of each of the input image data 64 and the input image data 65. Herein, the gray scale level to be 0 is maintained at the high value of 2. In addition, each of the corresponding write gray scale level data 94 and the corresponding write gray scale level data 95 has contents of (1, 148, 1, 1). Herein, the gray scale level to be 0 is remained at 1. The pixel corresponding to the gray scale level of 1 is displayed as a dark line. Consequently, noise in a form of an after-image, which is caused when the white line is shifted, is left in the displayed image.

The reason for generation of the after-image noise is described below. That is, a gray scale level value of input image data largely varies and then returns to its original value in one frame. Moreover, gray scale level values in a corresponding block of achievable gray scale level data are largely different from a mean gray scale level value of preceding frame image data PD obtained by high compression of the achievable gray scale level data. In such cases, even when the gray scale level value of the input image data returns to its original value, a gray scale level value of write gray scale level data does not return to its original value.

Figure 9:
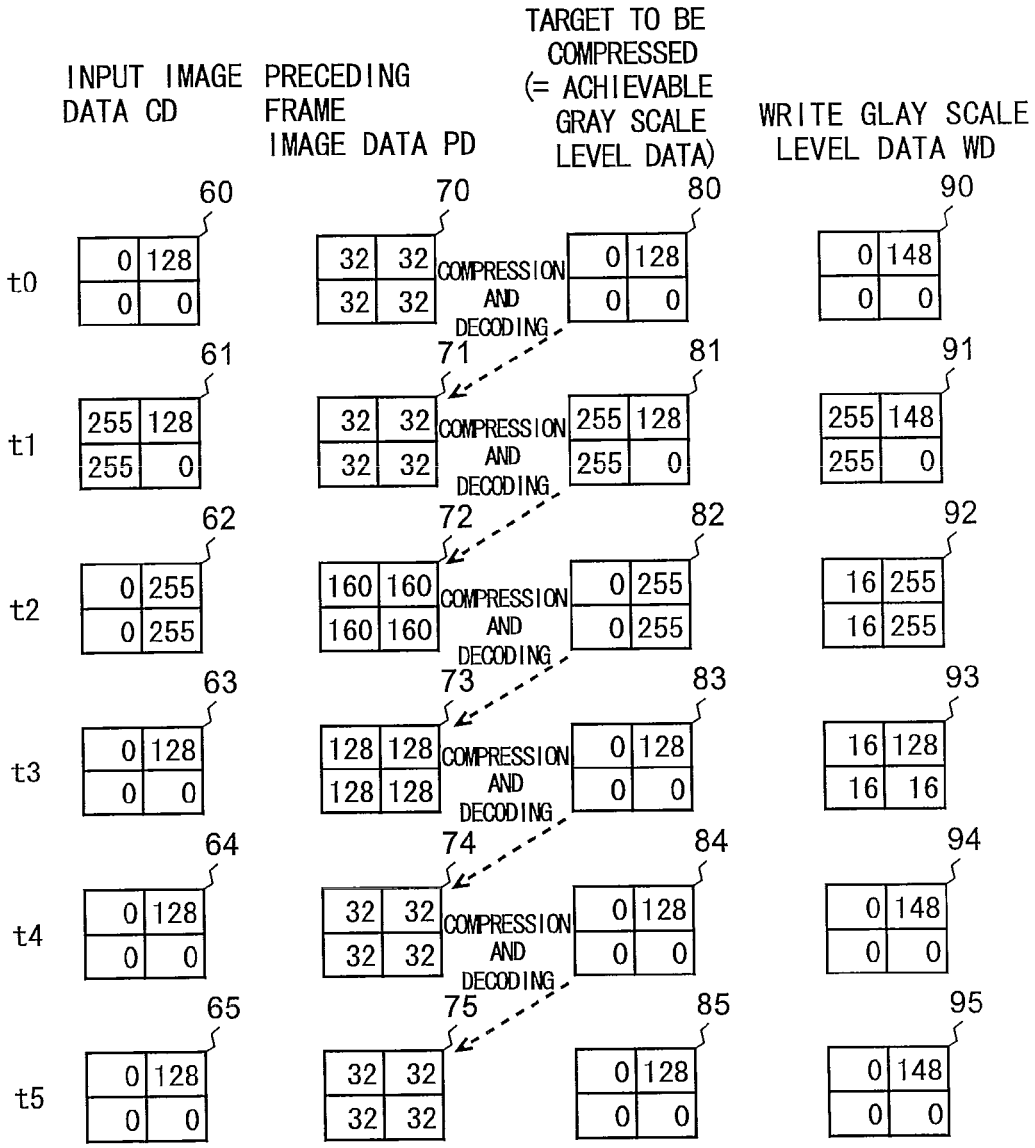
FIG. 9 shows an example of gray scale level values of four pixels in one block contained in each data in the embodiment.

The data selecting part 17 and the error noise predicting part 18 are provided for preventing the generation of the after-image noise. With reference to FIG. 9, next, description will be given of a fact that no after-image noise is generated even in a case where the image compressing part 11 receives plural pieces of input image data CD which are identical with one another.

FIG. 9 shows an example of gray scale level values of four pixels in one block contained in each data in this embodiment. The data as a target to be compressed in FIG. 9 is input image data and is different from the target to be compressed in FIG. 8 (i.e., achievable gray scale level data). The reason therefor is described below. That is, the error noise predicting part 18 compares, with a predetermined threshold value (herein, 95), predicted values as differences between gray scale level values of the four pixels in each of plural pieces of input image data 60 to 65 and a mean gray scale level value of these gray scale level values. As a result of the comparison, at least one of the predicted values exceeds the threshold value. In this case, the error noise predicting part 18 controls the data selecting part 17 such that the data selecting part 17 gives, to the image compressing part 11, the input image data CD rather than the achievable gray scale level data.

At the time t0, for example, the input image data 60 has the contents of (0, 128, 0, 0), the mean value of 32, and the predicted values of (32, 96,32, 32). As a result, the predicted value of 96, which corresponds to the gray scale level data of the upper right pixel, exceeds the threshold value of 95. At the time t1, moreover, the input image data 61 has the contents of (255, 128, 255, 0), the mean value of 160, and the predicted values of (95, 32, 95, 160). As a result, the predicted value of 160, which corresponds to the gray scale level data of the lower right pixel, exceeds the threshold value of 95. As described above, at least one of the predicted values exceeds the threshold value at all the times. Therefore, the target to be compressed by the image compressing part 11 is the input image data CD.

It is apparent from the comparison of the write gray scale level data 95 in FIG. 9 with the write gray scale level data 95 in FIG. 8 that all the gray scale level values are 0 except the gray scale level value of the upper right pixel which is slightly larger than the corresponding gray scale level value of the input image data 65. That is, these gray scale level values are not 1 which is displayed as after-image noise. Accordingly, it can be understood that this configuration prevents generation of after-image noise or prevents at least perception of such after-image noise.

According to this embodiment, in order to perform the overshoot drive for improving the optical response characteristics of the liquid crystal, the input image data CD or the achievable gray scale level data corresponding to the preceding frame image data PD in the preceding frame is compressed and stored. However, this operation is not necessarily performed for the purpose of performing the overshoot drive as long as the input image data CD is corrected or converted based on the image data corresponding to the preceding frame image data PD in the preceding frame during which the data is compressed and decoded. That is, the input image data CD may be converted or corrected for any purpose. Accordingly, the display control circuit does not necessarily control the liquid crystal display device.

5. Advantageous Effects

In the display control circuit according to this embodiment, as described above, the image compressing part 11 compresses image data to a code containing a fixed length portion without fail and occasionally containing a variable length portion, and then the image decoding part 15 decodes the code in an irreversible manner. In such a case, the error noise predicting part 18 compares, with a predetermined threshold value, predicted values as differences between gray scale level values (of the respective four pixels) contained in input image data and a mean gray scale level value of these gray scale level values. As a result of the comparison, when at least one of the predicted values exceeds the threshold value, the data selecting part 17 is controlled to give, to the image compressing part 11, input image data CD rather than achievable gray scale level data. This configuration prevents generation of after-image noise or prevents at least perception of such after-image noise.

While the invention has been described in detail, the foregoing description is in all aspects illustrative and not restrictive. It is understood that numerous other modifications and variations can be devised without departing from the scope of the invention.

This application claims priority on Japanese Patent Application No. 2008-161342, "DISPLAY CONTROL CIRCUIT, LIQUID CRYSTAL DISPLAY DEVICE INCLUDING THE SAME, AND DISPLAY CONTROL METHOD", filed on Jul. 20, 2008, the entire contents of which are incorporated herein by reference.

The invention claimed is:

1. A display control circuit for receiving external input image data to generate write gray scale level data to be given to a display panel for displaying an image, the display control circuit comprising:

a write gray scale level determining part for generating the write gray scale level data by correcting the received input image data in accordance with an amount of shift from a gray scale level represented by preceding frame image data generated based on input image data in an immediately preceding frame period to a gray scale level represented by the currently received input image data;

an achievable gray scale level determining part for generating, in accordance with the amount of shift, achievable gray scale level data of a gray scale level estimated to be displayed after a lapse of one frame period on the display panel to which the write gray scale level data is given;

a predicting and selecting part for predicting whether abnormal noise will be generated in the image to be displayed on the display panel according to the achievable gray scale level data, and selecting the achievable gray scale level data when it is predicted that no abnormal noise will be generated while selecting the input image data when it is predicted that the abnormal noise will be generated;

a compressing part for compressing the data selected by the predicting and selecting part, in an irreversible manner, to a variable length code containing a fixed length portion code generated without fail and a variable length portion code generated only in a predetermined case, for each block including plural pieces of pixel data;

a data storing part for storing the variable length code obtained by the data compression in the compressing part; and a decoding part for reading the variable length code from the data storing part, decoding the variable length code, and giving the decoded data as preceding frame image data in an immediately subsequent frame period to each of the write gray scale level determining part and the achievable gray scale level determining part, wherein the predicting and selecting part predicts, based on the plural pieces of pixel data contained in the input image data, the generation of the abnormal noise related to an error to be caused when the compressing part compresses the achievable gray scale level data in the irreversible manner and then the decoding part decodes the compressed data.

2. The display control circuit according to claim 1, wherein the predicting and selecting part obtains differential values between a plurality of gray scale level values indicated by the plural pieces of pixel data and a representative value determined based on the plurality of gray scale level values, and predicts that the abnormal noise is generated when at least one of the differential values exceeds a predetermined threshold value while predicting that no abnormal noise is generated when all the differential values do not exceed the threshold value.

3. The display control circuit according to claim 2, wherein the compressing part performs the data compression by use of a BTC (Block Truncation Coding) method, and the predicting and selecting part defines, as the representative value, a mean value of the plurality of gray scale level values.

4. A liquid crystal display device comprising:

the display control circuit according to claim 1; and a liquid crystal display panel for displaying an image based on write gray scale level data given from the display control circuit, the liquid crystal display panel including a video signal line drive circuit for driving a plurality of video signal lines for transmitting a plurality of video signals corresponding to the write gray scale level data, a scanning signal line drive circuit for driving a plurality of scanning signal lines intersecting the plurality of video signal lines, a plurality of pixel formation portions arranged in a matrix form along the plurality of video signal lines and the plurality of scanning signal lines, and a common electrode for giving a common potential to each of the plurality of pixel formation portions.

5. A display control method for receiving external input image data to generate write gray scale level data to be given to a display panel for displaying an image, the display control method comprising:

a write gray scale level determining step of generating the write gray scale level data by correcting the received input image data in accordance with an amount of shift from a gray scale level represented by preceding frame image data generated based on input image data in an immediately preceding frame period to a gray scale level represented by the currently received input image data;

an achievable gray scale level determining step of generating, in accordance with the amount of shift, achievable gray scale level data of a gray scale level estimated to be displayed after a lapse of one frame period on the display panel to which the write gray scale level data is given;

a predicting and selecting step of predicting whether abnormal noise will be generated in the image to be displayed on the display panel according to the achievable gray scale level data, and selecting the achievable gray scale level data when it is predicted that no abnormal noise will be generated while selecting the input image data when it is predicted that the abnormal noise will be generated;

a compressing step of compressing the data selected in the predicting and selecting step, in an irreversible manner, to a variable length code containing a fixed length portion code generated without fail and a variable length portion code generated only in a predetermined case, for each block including plural pieces of pixel data; and a decoding step of reading the variable length code stored in a data storing part for storing the variable length code obtained by the data compression in the compressing step, decoding the variable length code, and giving the decoded data as preceding frame image data in an immediately subsequent frame period to each of the write gray scale level determining step and the achievable gray scale level determining step, wherein the predicting and selecting step includes predicting, based on the plural pieces of pixel data contained in the input image data, the generation of the abnormal noise related to an error to be caused when the achievable gray scale level data is compressed in the irreversible manner in the compressing step and then the compressed data is decoded in the decoding step.

6. A liquid crystal display device comprising:

the display control circuit according to claim 2; and a liquid crystal display panel for displaying an image based on write gray scale level data given from the display control circuit, the liquid crystal display panel including a video signal line drive circuit for driving a plurality of video signal lines for transmitting a plurality of video signals corresponding to the write gray scale level data, a scanning signal line drive circuit for driving a plurality of scanning signal lines intersecting the plurality of video signal lines, a plurality of pixel formation portions arranged in a matrix form along the plurality of video signal lines and the plurality of scanning signal lines, and a common electrode for giving a common potential to each of the plurality of pixel formation portions.

7. A liquid crystal display device comprising:

the display control circuit according to claim 3; and a liquid crystal display panel for displaying an image based on write gray scale level data given from the display control circuit, the liquid crystal display panel including a video signal line drive circuit for driving a plurality of video signal lines for transmitting a plurality of video signals corresponding to the write gray scale level data, a scanning signal line drive circuit for driving a plurality of scanning signal lines intersecting the plurality of video signal lines, a plurality of pixel formation portions arranged in a matrix form along the plurality of video signal lines and the plurality of scanning signal lines, and a common electrode for giving a common potential to each of the plurality of pixel formation portions.

* * * * *